US011691436B2

(12) United States Patent
Ringeisen et al.

(10) Patent No.: US 11,691,436 B2
(45) Date of Patent: Jul. 4, 2023

(54) ISOLATION OF MICRONICHES FROM SOLID-PHASE AND SOLID SUSPENSION IN LIQUID PHASE MICROBIOMES USING LASER INDUCED FORWARD TRANSFER

(71) Applicant: The Government of the United States of America, as represented by the Secretary of the Navy, Arlington, VA (US)

(72) Inventors: Bradley R. Ringeisen, Lorton, VA (US); Peter K. Wu, Ashland, OR (US)

(73) Assignee: The Government of the United States of America, as represented by the Secretary of the Navy, Washington, DC (US)

( * ) Notice: Subject to any disclaimer, the term of this patent is extended or adjusted under 35 U.S.C. 154(b) by 389 days.

(21) Appl. No.: 15/202,000

(22) Filed: Jul. 5, 2016

(65) Prior Publication Data

US 2017/0002344 A1 Jan. 5, 2017

Related U.S. Application Data

(60) Provisional application No. 62/188,005, filed on Jul. 2, 2015.

(51) Int. Cl.
*B41J 2/44* (2006.01)

(52) U.S. Cl.
CPC ..... *B41J 2/442* (2013.01)

(58) Field of Classification Search
None
See application file for complete search history.

(56) References Cited

U.S. PATENT DOCUMENTS

| | | | |
|---|---|---|---|
| 7,294,367 | B2 | 11/2007 | Barron et al. |
| 7,381,440 | B2 | 6/2008 | Ringeisen et al. |
| 7,875,324 | B2 | 1/2011 | Barron et al. |
| 2005/0018036 | A1 | 1/2005 | Barron et al. |
| 2015/0322485 | A1 | 11/2015 | Kwon et al. |

FOREIGN PATENT DOCUMENTS

| | | | |
|---|---|---|---|
| WO | 03056320 | A2 | 7/2003 |
| WO | 2014-088380 | A1 | 6/2014 |

OTHER PUBLICATIONS

Butler, M. Culture conditions. In: Animal Cell Culture and Technology. Garland Science/BIOS Scientific Publishers. First published 2004. Ed.: Georgia Bushell. Garland Sciences/BIOS Scientific Publishers. Oxon, UK. pp. 63, 64.*

Ringeisen, B.R. et al. Single cell isolation of bacteria from microbial fuel cells and Potomac river sediment. Electroanalysis 22(7-8): 875-882. specif. pp. 875, 876, 877, 880, 881.*

PhysOrg. Jan. 27, 2014. 3D printed soil reveals the world beneath our feet. Datasheet [online], Univ. of Abertay Dundee [retrieved on Jun. 28, 2018-06-28], Retrieved from the internet: <https://phys.org/news/2014-01-3d-soil-reveals-world-beneath.html> pp. 1-3.*

Scholl, M.A. et al. 1992. Laboratory investigations on the role of sediment surface and groundwater chemistry in transport of bacteria through a contaminated sandy aquifer. Environmental Science & Technology 26(7): 1410-1417. specif. p. 1410.*

Glenn,J. 1988. Bottom sediments and nutrients in the tidal Potomac system, Maryland and Virginia. United States Geological Survey (USGS) Water-Supply Paper 2234-F. Particle Size. pp. F1-F74. specif. pp. F15, F17.*

Page, H.G. 1955. Phi-millimeter conversion table. Journal of Sedimentary Petrology 25(4): 285-292. specif. p. 291.*

Hardy Diagnostics. Bacillus. Datasheet [online]. Hardy Diagnostics. Copyright 1996-2016. Downloaded on Dec. 4, 2019. Downloaded from the internet: <https://catalog.hardydiagnostics.com/cp_prod/Content/hugo/Bacillus.htm> pp. 1-3. specif. p. 1.*

Encyclopaedia Britannica.Stoke's Law. Date published: Apr. 9, 2021. Encyclopaedia Britannica, Inc. Retrieved Apr. 21, 2021. Downloaded from the internet: <https://www.britannica.com/print/article/567002> p. 1 (alternatively, <https://www.britannica.com/science/Stokess-law>).*

Ringeisen et al., "Printing soil: a single-step, high-throughput method to isolate micro-organisms and near-neighbour microbial consortia from a complex environmental sample" Methods in Ecology and Evolution 2015, 6, 209-217 (Nov. 26, 2014).

Ringeisen et al., "High Throughput Soil Printing: A Micro-Scale Tool to Isolate and Study Rhizosphere Species" Phytobiomes 2015 poster session (Jun. 30, 2015).

Search Report and Written Opinion in PCT/US2016/040961 (dated Oct. 14, 2016).

Barron et al., "Biological laser printing of genetically modified *Escherichia coli* for biosensor applications" Biosensors and Bioelectronics 20 (2004) 246-252.

EPO Communication in Appl. No. 16818952.0 (dated Jan. 14, 2019).

* cited by examiner

*Primary Examiner* — Renee Claytor
*Assistant Examiner* — Sharon M. Papciak
(74) *Attorney, Agent, or Firm* — US Naval Research Laboratory; Joseph T. Grunkemeyer

(57) ABSTRACT

A method for printing materials by: providing a receiving substrate; providing a target substrate having a photon-transparent support, a photon absorbent interlayer coated on the support, and a transfer material of a solid-phase environmental sample coated on top of the interlayer opposite to the support; and directing photon energy through the transparent support so that the photon energy strikes the interlayer is described. The environmental sample includes living organisms. A portion of the interlayer is energized by absorption of the photon energy, and the energized interlayer causes a transfer of a portion of the environmental sample including the microorganisms across a gap between the target substrate and the receiving substrate and onto the receiving substrate.

26 Claims, 9 Drawing Sheets

Average Droplet Diameter (µm)

430 ± 50

280 ± 45

170 ± 30

ISOLATION OF MICRONICHES FROM SOLID-PHASE AND SOLID SUSPENSION IN LIQUID PHASE MICROBIOMES USING LASER INDUCED FORWARD TRANSFER

This application claims the benefit of U.S. Provisional Application No. 62/188,005, filed on Jul. 2, 2015. The provisional application and all other publications and patent documents referred to throughout this nonprovisional application are incorporated herein by reference.

TECHNICAL FIELD

The present disclosure is generally related to isolation and deposition of microorganisms from solid-phase and solid suspension in liquid phase microbiomes.

DESCRIPTION OF RELATED ART

Microbiomes are defined herein as complex organizations of microorganisms (i.e. at least two different types of microorganisms) in a particular environment (for example but not limited to soil, sediment, water, biofilm, tissue from human, animal and plant sources, human and animal feces, agricultural products and waste, food production products and waste, medical products and waste, industrial products and waste, and waste disposal material). Microbiomes also include the combined genetic material of the microorganisms in a particular environment. For the purpose of this application, a microbiome sample is comprised of the microorganisms and their combined genetic material in their nascent environment. A microniche is defined as a subset of the whole microbiome with all dimensions below 1 cm and mass below 0.1 gram while preserving the nascent biological and chemical composition and environment.

Traditional analysis of microbiomes occurs at the gram scale. Microbiomes are traditionally sampled at a centimeter scale or above a 0.1 gram scale followed by post-processing for culture or genomic analysis such as metagenomics analysis or high throughput sequencing. In all current state-of-the-art techniques, sampling and post-processing for culture or sequencing analyses lose spatial orientation of the sample below the 0.1 g and centimeter scale. Existing art is incapable of probing neither microniches within microbiomes nor the close-proximity spatial relationship between microorganisms and their nascent environment in a microniche.

It is a well-accepted paradigm in microbial ecology and environmental microbiology that the majorities of microorganisms in the world are "unculturable" and therefore remain largely uncharacterized (Amann et al., *Microbiol. Rev.* 1995, 59(1), 143-169; Keller et al., *Nat. Rev. Microbiol.* 2004, 2(2), 141-150; Pace, *Science* 1997, 276(5313), 734-740). This knowledge is so pervasive that there is a common lab experiment referred to as the "The Great Plate Count Anomaly", where viable colony counts from an environmental sample will routinely be orders of magnitude lower than direct cell counts from the same sample (Tandogan et al., *PLoS ONE* 2014, 9(6), e101429). With the advent of next generation sequencing, it has become quantitatively evident that banks of culturable microorganisms pale in comparison to the number actually present in natural environments with percentages usually falling below 0.1% (Amann, *Syst. Appl. Microbiol.* 2000, 23(1), 1-8; Handelsman, *Microbiol. Mol. Biol. Rev.* 2004, 68(4), 669-685; Rondon et al., *Appl. Environ. Microbiol.* 2000, 66(6), 2541-2547).

One of the problems facing scientists attempting to culture and characterize environmental microorganisms is scale (Rappé et al., *Annu. Rev. Microbiol.* 2003, 57, 369-394). The sheer number of "unculturables" is astonishing. Even if one could isolate and culture thousands of "unculturables" every year, it would take centuries of research to characterize the millions of uncharacterized species on Earth, with many of those species known to reside in solid-phase environments such as terrestrial soils and ocean sediments (Amann, *Syst. Appl. Microbiol.* 2000, 23(1), 1-8; Bowman et al., *Appl. Environ. Microbiol.* 2003, 69(5), 2463-2483; Groffman et al., *BioScience* 1999, 49(2), 139; Luna et al., *Appl. Environ. Microbiol.* 2002, 68(7), 3509-3513; Snelgrove *Ambio* 1997, 578-583). Many scientists also believe that the phrase "unculturable" is a misnomer as any microorganism could potentially be cultured under the proper mineral, nutrient and media compositions or when grown in the presence of optimal microbial consortia (Joint et al., *Microb. Biotechnol.* 2010, 3(5), 564-575). In short, some of the greatest challenges facing microbial ecologists and environmental microbiologists today are (i) rapidly and efficiently isolating single cells from environmental samples in a high-throughput fashion, (ii) identifying consortia of symbiotic and/or interdependent micro-organisms from environmental samples, and (iii) ultimately finding the proper microbial ecology (e.g. the physical, biological and chemical conditions) under which the "unculturables" could potentially be cultured.

It is therefore no surprise that many high throughput screening (HTS) approaches have emerged recently to isolate and culture viable microorganisms from environmental samples. Most of these approaches rely upon microfabrication and/or microfluidics to autonomously capture single microorganisms from highly complex, mixed microbial liquid cultures. One such device is called the iChip which is a microfabricated plate that can be submerged in liquid cultures (Nichols et al., *Appl. Environ. Microbiol.* 2010, 76(8), 2445-2450). The iChip filter surface was designed for single cell capture with the goal of then returning the multi-well chip to the natural environment for culture, where the filter allows nutrients to pass but is impenetrable to other microbial species. Other microfabricated structures have been used to turn macroscopic agar plates into ultra-high throughput ($10^6$ isolates/plate) culture arrays (Ingham et al., *Proc. Natl. Acad. Sci.* 2007, 104(46), 18217-18222). Still other microfluidic devices allow single organisms to compete for small culture spaces that can then be assayed for growth and identification, or encapsulate cells into micro-particles for further study (Tandogan et al., *PLoS ONE* 2014, 9(6), e101429; Gao et al. *Microbiome* 2013, 1(1), 4; Zengler et al., *Proc. Natl. Acad. Sci.* 2002, 99(24), 15681-15686). It is safe to say that there have been tremendous advances achieved over the past decade in rapid and efficient methods to separate and isolate single micro-organisms from complex samples. It is yet to be seen whether these advances will ultimately lead to dramatic improvements in culturing the "unculturables", as it will still require highly parallel and multiple experiments to optimize media compositions for isolates and consortia derived from environmental samples.

Two common flaws are found in all of these HTS approaches. First, they require the microorganisms found growing in and on solid-phase environmental samples to be aggressively removed (via shaking, agitation, and sonication) from their environmental microniches prior to separation and isolation. It is unclear how easily and thoroughly microorganisms can be removed from their solid-phase niche (Amalfitano et al., *J. Microbiol. Methods* 2008, 75(2), 237-243), and in the case of sonication, cell lysing may also occur to some degree (Rantakokko-Jalava et al., *J. Clin. Microbiol.* 2002, 40(11), 4211-4217; Vollmer et al., *Appl. Environ. Microbiol.* 1998, 64(10), 3927-3931). It is probable that inefficient removal, cell damage and/or cell death alleviate significant biodiversity before isolation and culture is attempted. Secondly, these HTS approaches, due to the requirement that microorganisms be in liquid media, are incapable of retaining the spatial organization of microbial consortia in their natural habitat. By forcibly removing microorganisms from their solid-phase niche, scientists lose significant understanding of which microorganisms live in concert with one another and are potentially dependent upon one another for survival and growth (Joint et al., *Microb. Biotechnol.* 2010, 3(5), 564-575).

Over the past decade, bioprinting, including live mammalian cell and bacteria printing, has emerged as a robust research field (Ringeisen et al., *MRS Bulletin* 2013, 38, 834-843). Printers ranging from modified ink jet printers, extrusion pens, electrospinning, and laser-based tools have demonstrated the ability to create submillimeter resolution patterns of biomaterials. Viability assays, genetic damage assays, cell differentiation and stress assays have been performed post-printing to demonstrate that each of these tools can form patterns and 3D structures of undamaged, living cells (down to the scale of printing single cells) directly without the aid of surface functionalization or patterning (lithography, masking, etc.) (Barron et al., *Biomedical Microdevices,* 2004, 6, 139-147; Barron et al., *Annals of Biomedical Engineering,* 2005, 33, 121-130). Bioprinters have been used to deposit living systems ranging from stem cells, bacteria, and viruses and are currently being used in laboratories around the world to create microarrays and in vitro 3D tissue models (Barron et al., *Biosensors & Bioelectronics,* 2004, 20, 246-252; Mironov et al., *Regenerative Medicine,* 2008, 3, 93-103; Fitzgerald et al., *Journal of Virological Methods,* 2010, 167, 223-225; Visconti et al., *Expert Opinion on Biological Therapy,* 2010, 10, 409-420).

BRIEF SUMMARY

Disclosed herein is a method for printing materials comprising the steps of: providing a receiving substrate; providing a target substrate comprising a photon-transparent support, a photon absorbent interlayer coated on the support, and a transfer material comprising a solid-phase microbiome sample coated on top of the interlayer opposite to the support; providing a source of photon energy; and directing the photon energy through the transparent support so that the photon energy strikes the interlayer. A portion of the interlayer is energized by absorption of the photon energy, and the energized interlayer causes a transfer of a portion of the transfer material across a gap between the target substrate and the receiving substrate and onto the receiving substrate.

Also disclosed herein is a substrate comprising: a photon-transparent support, a photon absorbent interlayer coated on the support, and a transfer material comprising a solid-phase microbiome sample coated on top of the interlayer opposite to the support

BRIEF DESCRIPTION OF THE DRAWINGS

A more complete appreciation will be readily obtained by reference to the following Description of the Example Embodiments and the accompanying drawings.

FIG. 2A: 23 μJ, FIG. 2B: 14 μJ, FIG. 2C: 9 μJ, and FIG. 2D: 7 μJ.

FIG. 3A: 23 μJ, FIG. 3B: 14 μJ, and FIG. 3C: 9 μJ.

FIGS. 5A-D show one colony morphology, size and color per sample, indicating soil printing most likely resulted in isolation of a single culturable species. Images were selected to show diversity of isolated species. FIGS. 5E-H show multiple morphologies, sizes and colors per sample, indicating soil printing isolated 2-4 culturable microorganisms (consortia) that grow in close proximity (<170 μm) to one another in the natural soil sample.

FIG. 6A: 23 μJ, FIG. 6B: 14 μJ, FIG. 6C: 9 μJ, and FIG. 6D: 7 μJ

DETAILED DESCRIPTION OF EXAMPLE EMBODIMENTS

In the following description, for purposes of explanation and not limitation, specific details are set forth in order to provide a thorough understanding of the present disclosure. However, it will be apparent to one skilled in the art that the present subject matter may be practiced in other embodiments that depart from these specific details. In other instances, detailed descriptions of well-known methods and devices are omitted so as to not obscure the present disclosure with unnecessary detail.

Disclosed herein is a method to isolate soil and sediment microniches directly and in a high throughput manner while retaining the spatial position and viability of microorganisms attached to microparticles as they are originally found in an environmental sample.

The method can isolate microniches from microbiomes (sub-cm portions of the microbiome that contain a dissected portion of microorganisms and/or retained genetic material from the microorganisms) that include individual microorganisms and consortia of microorganisms with retained viability. The method performs these isolations without having to remove microorganisms from their solid-phase support such as the natural state of the microbiome in the nascent environment (e.g., spatially preserved samples from soil and sediment cores, sample from a biofilm or a tissue biopsy). The method uses a nozzle-free, laser-based printing approach to excise microscale portions of the microbiome sample, thereby decreasing the complexity by dramatically reducing the size scale. It is also a high throughput method, enabling thousands of microniches to be isolated and deposited into high throughput analysis or culturing platforms such as microtiter plates within a few minutes. Once isolated, these microniches can be used for study and discovery including: 1) metagenomics analysis and next generation sequencing to (a) characterize organizations of microorganisms in their nascent environment, (b) identify neighbor and near-neighbor species that could unlock symbiotic relationships between microorganisms used in their nascent environment, or (c) identify relationships between microorganisms and their nascent environment (e.g., human, animal, or plant tissue, organic and inorganic soil components, biofilm extracellular polymeric substance); 2) high throughput culturing studies of isolates or consortia to determine optimal growth conditions; and 3) microscale chemical analysis to determine the organic and inorganic components of each microniche. One example of this process is the demonstration that soil microniches can retain viable microorganisms post-printing and that both pure cultures and low-number consortia can be isolated via this method.

Figure 1:
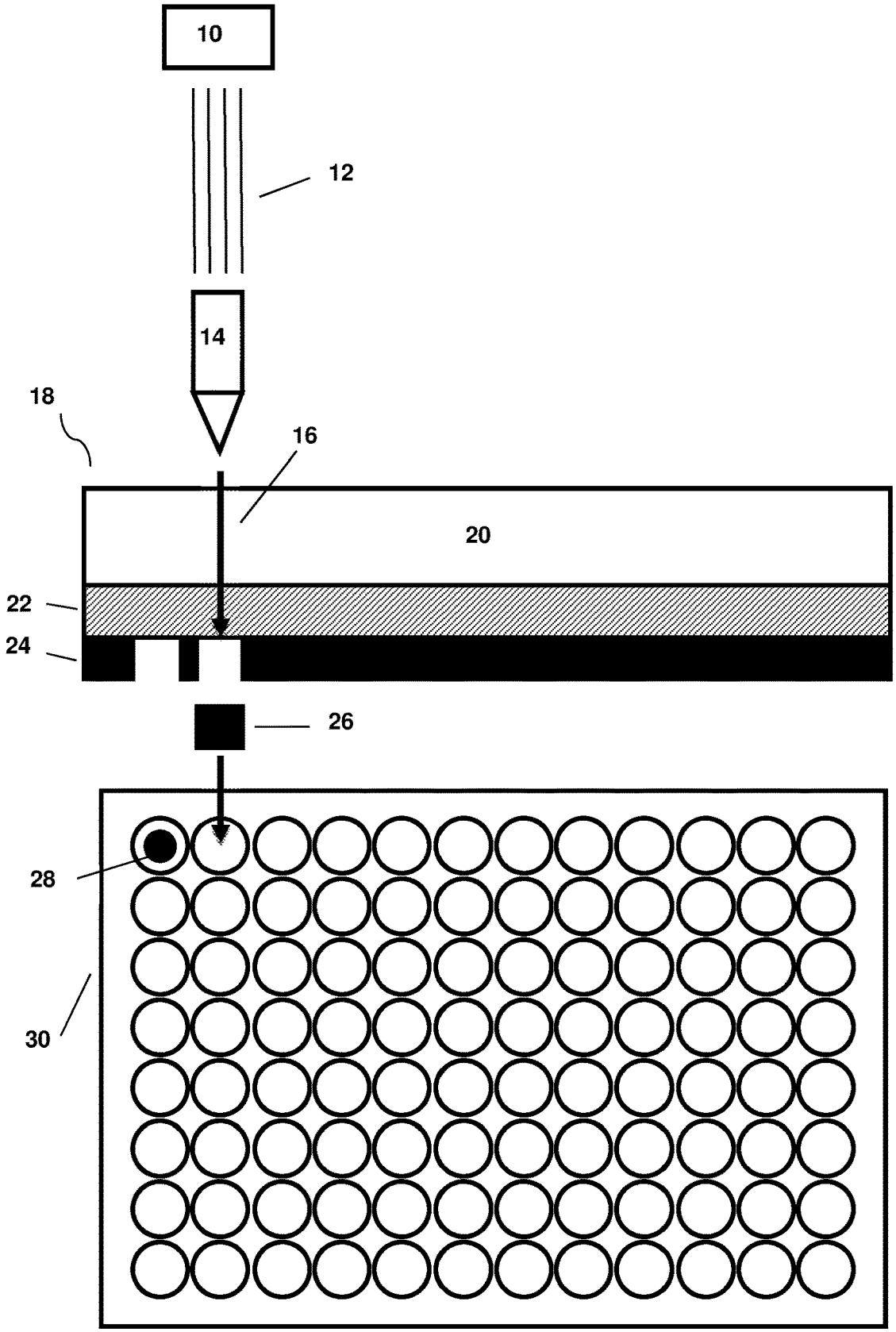
FIG. 1 schematically illustrates the soil printing process.

The method uses the patented Biological Laser Printing, or BioLP, platform that has been shown to print microscale droplets of biological materials including living bacteria and mammalian cells (U.S. Pat. Nos. 7,294,367; 7,875,324; and 7,294,367, all incorporated herein by reference. All methods and materials disclosed therein may be used in any combination in the presently disclosed method.). The present method can expand this printing approach to any solid-phase, complex microbial system (i.e., microbiome) including soil, sediment, the human microbiome (microorganisms living and growing at the interface of human tissues such as intestinal gut, lung, skin and vaginal), and biofilms in both human and natural environments. The process is depicted in FIG. 1 as it relates to printing microniches of soil. A source of photon energy 10, such as a laser or flash lamp, produces photon energy 12, such as a laser beam. The beam 12 may be passed through a focusing objective 14 and through 16 a target substrate 18. The target substrate 18 has a photon-transparent support 20 or "ribbon". The ribbon is previously coated with a photon absorptive interlayer 22. Suitable materials for the target substrate 18 include quartz, sapphire, or amorphous silica for the ribbon and coated with a nm-scale (5-100 nm) titania, gold, gold alloy, platinum, or titanium as the photon absorptive interlayer.

The titania layer 22 absorbs the incident UV laser pulse 16 and initiates via a photothermal and/or photomechanical process the forward transfer of a voxel 26 of material 24 coated directly on top (shown in the schematic the bio-ink layer is directly below the titania energy transfer layer). The size and amount of bio-ink transferred by the laser pulse can be varied based on the diameter of the beam spot and the incident energy of the laser.

The transferred material 26 lands on a receiving substrate 30, which may be a multi-well plate. FIG. 1 shows a volume 28 that has already been transferred to the first well, and a second volume 26 in motion towards the plate 30. Any of the laser, target substrate, and the receiving substrate may be independently movable in order to transfer materials from any location on the target substrate into different places on the receiving substrate or wells.

The application of this method towards the isolation of unperturbed solid-phase microniches from microbiomes had not been previously demonstrated. Specifically, this nozzle-free printer can isolate the biological and chemical components of microscale fractions of a complex microbiome rapidly and without harming the living components, and can isolate microorganisms or consortia of microorganisms directly from a solid-phase sample without the need to vortex or sonicate the sample to remove viable microorganisms prior to isolation. The method can be used to deposit microscale portions of a microbiome into high throughput culture plates, which upon further investigation were shown to contain single and multiple culturable species of micro-organisms.

The microbiome sample may be applied to the target substrate by mixing it with a liquid to form a solid-phase suspension, and forming a layer of the suspension on the interlayer. The suspension may be dried, but drying may not be necessary where the coating is already a solid or it is desired to keep the suspension as a liquid.

The sample may be applied to the target substrate by adhering slices of the solid-phase microbiome sample onto the target substrate. A fluid may also be used between the sample and the target substrate to aid in adherence. The sample preparation process would be somewhat similar for any solid-phase microbiome. The commonality is the need to (a) sample in such a way as to preserve the spatial organization of the sample (soil core, tissue biopsy, etc.), and (b) slice the microbiome sample thin enough to enable laser printing while retaining the spatial organization of the sample.

The receiving substrate may be one that promotes the growth of any micro-organisms by, for example, having a culturing medium on the substrate. The receiving substrate may also have reagents for lysing and genetic processing, such as PCR, of the micro-organisms. Such reagents include, but are not limited to, a pH buffer, a lysing buffer, a DNA amplification reagent, a PCR primer, a sequencing reagent, an RNA preserving reagent, or a transcript preserving reagent. The receiving substrate with the transferred material may be incubated as is, or the transferred material may be moved to another substrate for incubation.

The process of deconstructing a solid-phase microbiome has several applications, each of which does not change the basic mechanism of using this laser-based tool to isolate and print (forward transfer) a small portion of that microbiome. For instance, culturing microorganisms from this printing process could just involve using a receiving substrate with well-defined microbial growth media in a high throughput well plate and subsequently printing one or multiple portions of the microbiome into those wells. Secondly, one could print portions of the microbiome into a lysing buffer for subsequent DNA amplification and metagenomics sequencing. Additionally, one could print portions of the microbiome sample onto substrate for scanning mass spectrometry analysis, scanning electron microscopy or elemental analysis using energy dispersive spectroscopy (EDS).

The method was demonstrated using both liquid and solid compositions of soils from Northern Virginia. Three different top soil samples were obtained from Fairfax County, Va. using sterile 50 mL conical tubes. The samples were taken from a rocky shaded region primarily composed of marine clay. Soil was sampled within 5 cm of the surface. The samples were capped and stored at room temperature until used in the printing experiments, which were all performed within a week of sampling. A soil bio-ink was spread evenly on top of the titania layer on the quartz ribbon. The bio-ink was formed by gently mixing (stirring for 20 seconds) either (a) equal parts of a 50/50 volume mixture of glycerol/sterile water and soil, or (b) equal parts sterile water and soil. Other methods may be used to slice or stamp layers of a microbiome so as to not perturb the spatial distribution of micro-organisms in the microbiome prior to printing. Even through the bio-ink process, microorganisms were found to remain adhered to the soil process and in no case was vortexing or sonication used to separate the microorganisms from the soil particles. The bio-ink was then spread directly onto the titania-coated ribbon using a blade, creating a roughly 10 μm thick coating. In the case of the water/soil slurry, the layer dried into a solid coating which was adhered to the titania layer. In the case of the glycerol/water "bio-ink", the coating retained some moisture, imparted primarily by the non-volatile glycerol, but was still firmly adhered to the titania layer in solid form.

The soil-coated ribbon was then loaded into the BioLP apparatus, with the uncoated quartz side pointing upward towards a microscope focused UV laser pulse (FIG. 1). The laser spot size was focused by a 10× UV-coated objective to a 50-μm diameter. The BioLP apparatus was equipped with a CCD camera, enabling the user to observe the active transfer of material from the ribbon. Each UV laser pulse resulted in the transfer of a microparticle of soil material downward (away from the ribbon), towards a receiving substrate. The BioLP apparatus is configured to forward transfer the "bio-ink" in the same direction as gravity. After each laser pulse, the ribbon was moved two laser spot diameters by computer-controlled translation stages (Aerotech, Inc., Pittsburgh, Pa., USA) so that the subsequent laser pulse was exposed to a fresh portion of the soil coating. The receiving substrates used in this study were glass microscope slides, LB agar plates, and 96-well plates filled with 200 μL of sterile LB broth.

A range of laser energies from 7 to 23 μJ was investigated for both bio-ink compositions. An Excimer laser (MPB, Inc., Point-Claire, Quebec) source with a maximum pulse repetition rate of 100 Hz was used. Microarrays of printed soil were deposited to glass slides using this maximum repetition rate, but deposition to agar plates and 96-well plates required the use of a much slower repetition rate as the space between printed particles at times exceeded several millimeters. The maximum velocity of the translation stages used to computer-control the receiving substrate movement limited the pulse repetition rate in these cases to ~20 Hz. In all cases, one laser pulse was used to transfer soil micro-particles to one part of the receiving substrate or one microtiter plate well (multiple micro-particles were not deposited on top of one another). Printed arrays were created by repeating this process in concert with computer-controlled stage movement to rapidly generate spatially oriented patterns of printed soil.

Luria Bertani (LB) broth and agar (Difco; Life Technologies, Frederick, Md., USA) were used to culture micro-organisms in the printed soil microparticles. LB broth is a high nutrient growth media and was chosen not to select for specific species but to promote growth over a wide distribution of microbial phylum so that assessment of microbial viability and diversity post-printing could be performed. Positive growth stemming from printed soil microparticles was determined by colony formation and increased turbidity for LB agar plates and sterile LB broth-filled 96-well plates, respectively. In order to qualitatively ascertain the diversity of isolated micro-organisms and microbial consortia from the printed soil microparticles, 49 positive growth wells (out of the 264 soil printed wells) were selected for further study. Specifically, these cultures were streaked onto LB agar plates to determine how frequently pure isolated cultures were obtained vs. mixed consortia after one step of soil printing.

Figure 2A:
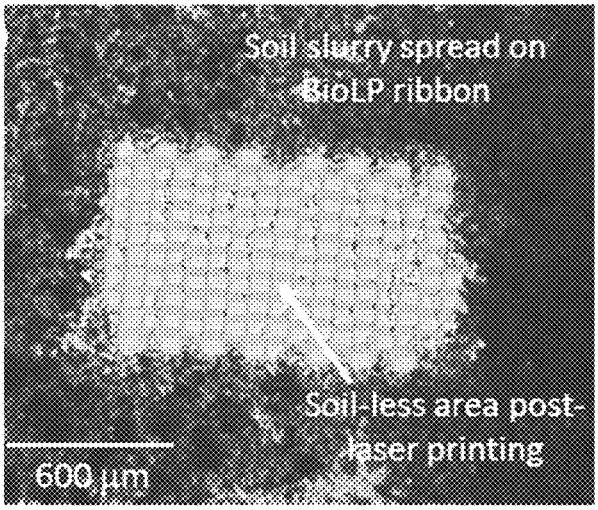
FIGS. 2A-D are micrographs showing differing amounts of soil removed from the ribbon via laser assisted transfer at a range of incident energies.
Figure 2B:
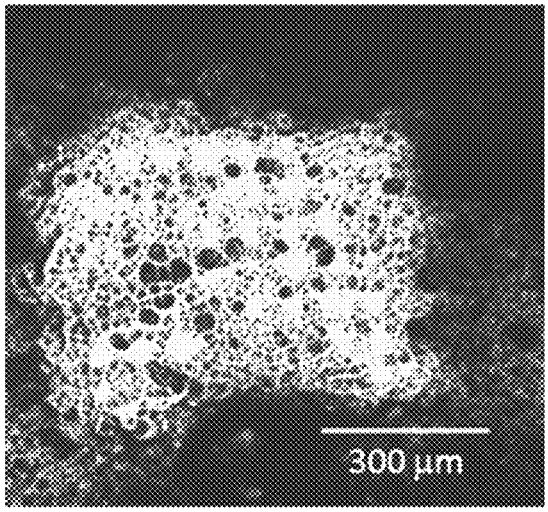
Figure 2C:
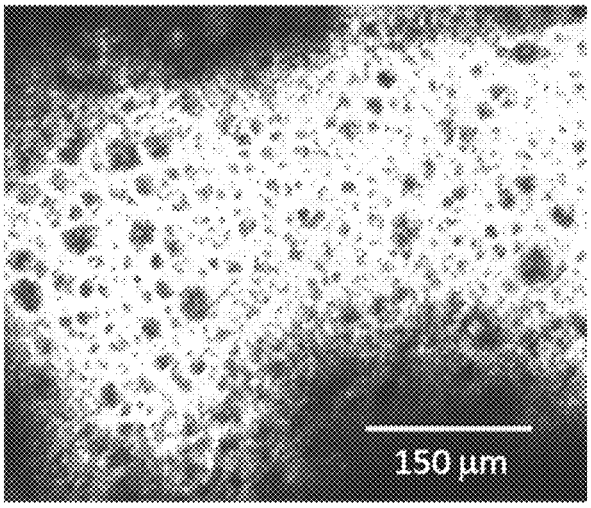
Figure 2D:
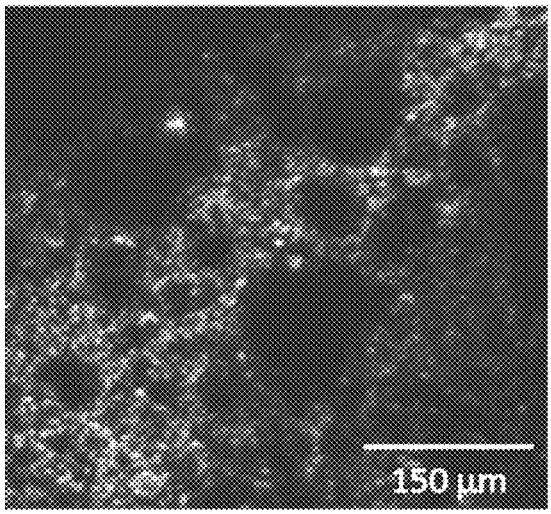

BioLP requires a thin layer of bio-ink (10-100 μm thick) of solid, liquid, or gel on the ribbon prior to printing. Both bio-ink composition and incident laser energy were investigated to optimize the printing process and demonstrate that different amounts of soil, and thereby total number of micro-organisms, could be deposited with each laser pulse. Both bio-ink compositions (water+soil only and water/glycerol+soil) resulted in adherent thin film formation onto the ribbon surface (dark portions shown in FIGS. 2A-D micrographs) and were investigated for printing at all laser energies investigated. FIGS. 2A, C, and D show solid/water/glycerol "bio-ink" films and FIG. 2B shows a water/soil film. The soil-less areas of the ribbon shown in FIGS. 2A-D are where the laser pulses were focused to generate microparticles of soil for printing. The diameter of the laser absorbance region (50±5 μm) was measured from the array of visible ablation marks where the titania was removed during the highest laser energy experiment. The images in FIG. 2 show that varying amounts of soil was removed from the ribbon for laser energies of A: 23 μJ, B: 14 μJ, C: 9 μJ, and D: 7 μJ. At the highest energies, the soil slurry was completely removed across the entire illuminated portion of the ribbon, as it was exposed to 150 rastered laser pulses. As the laser energy was decreased, less and less soil was removed by the printing process, meaning that fewer total microorganisms were removed per pulse at the lower energies. In the case of the lowest laser energy, the region of the ribbon exposed to the incident laser pulse appeared slightly lighter in color, indicating that a very small amount of soil was removed but the majority remained on the ribbon.

Figure 3A:
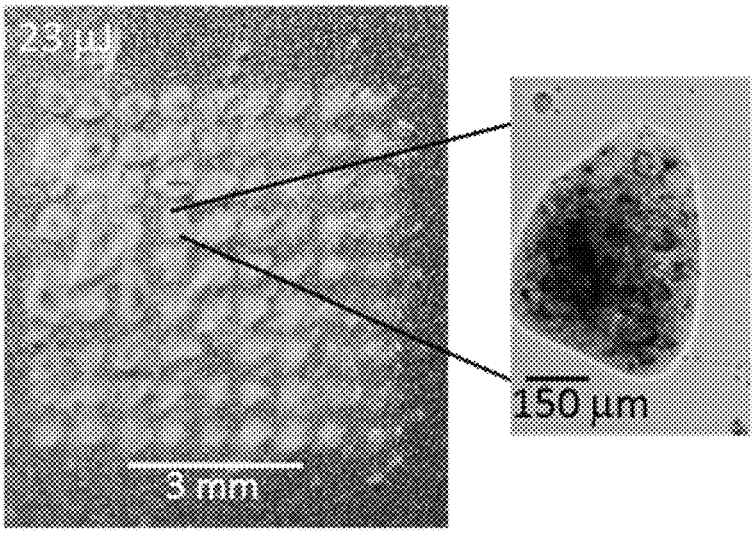
FIGS. 3A-C show printed soil arrays onto glass microscope slides demonstrating decreasing amounts of soil transfer at lower laser energies.
Figure 3B:
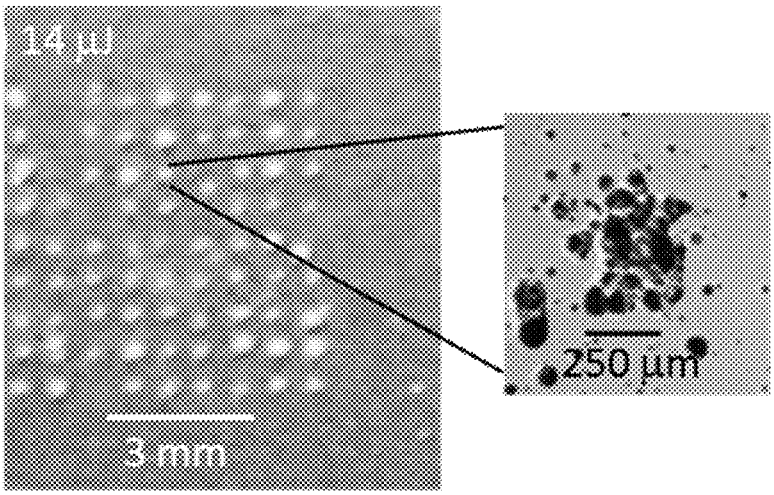
Figure 3C:
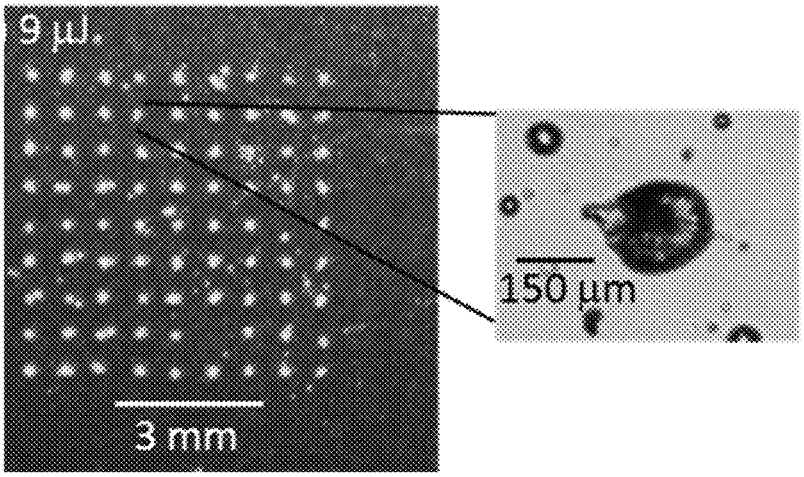

Microarrays of soil were printed to glass slides (FIGS. 3A-C) with a range of laser energies and bio-ink compositions. The deposited spot sizes ranged from approximately 0.5 mm down to 0.2 mm depending upon the energy and ink composition. Soil/water/glycerol bio-inks resulted in the best microarrays (most contiguous particles and least spray) for 9 and 23 μJ, while soil/water bio-inks resulted in optimal transfer for 14 μJ laser energies. The 7 μJ printing experiment did not result in a reproducible microarray. The scaling of the amount of printed soil with the incident laser energy shown in FIG. 3 correlated well with the results shown in FIG. 2 for the amount of soil removed per laser pulse at those energies. The optimized soil printing is remarkably reproducible with 95% confidence limits of 11% (23 μJ), 16% (14 μJ), and 18% (9 μJ) of the spot diameters and observable material transfer in 234 out of 243 attempts, or 96%.

Figure 6A:
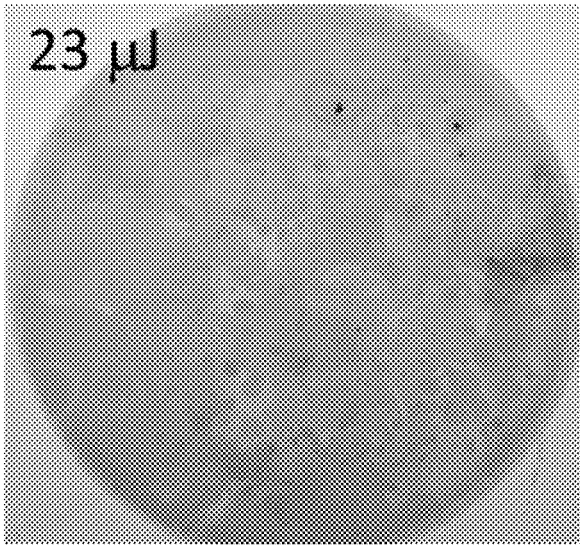
FIGS. 6A-D show representative examples of printed arrays of soil micro-droplets to LB agar plates. Photographs show arrays at varying incident laser energies and after 24 hours of culture post-printing.
Figure 6B:
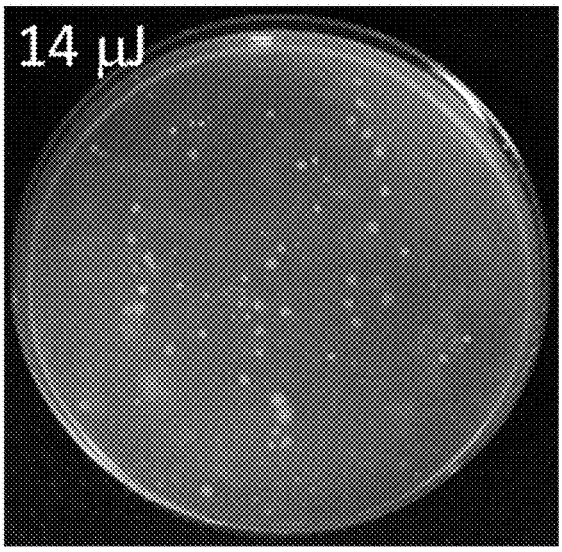
Figure 6C:
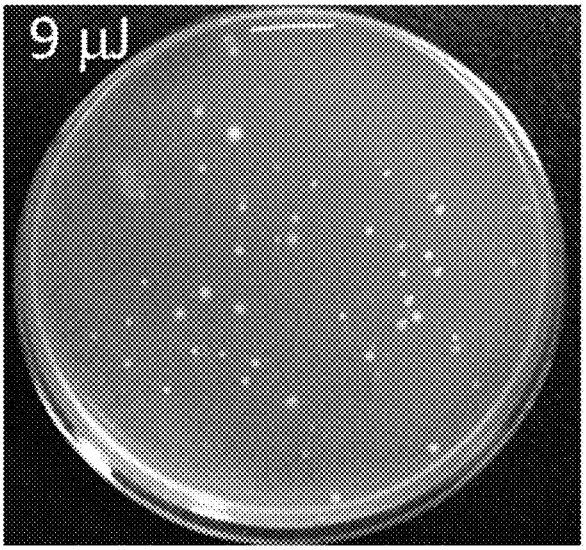
Figure 6D:
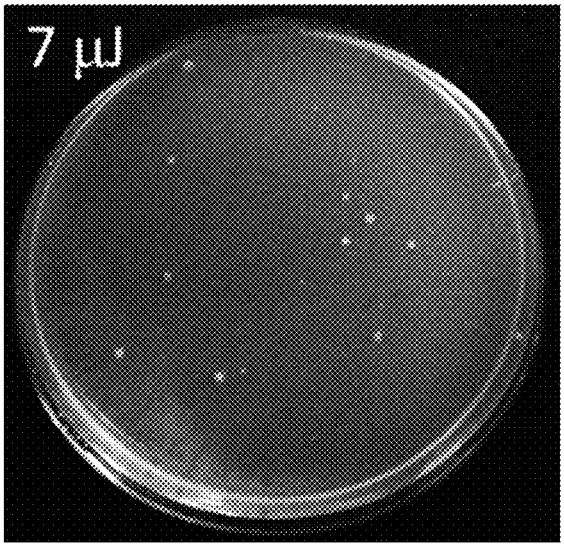

To demonstrate sustained microbial viability post-printing, 10×10 square arrays of soil microparticles were deposited with 6 mm spacing to two LB agar plates at each of the laser energies depicted in FIG. 2. The agar plates were then incubated at 30° C. for 24 h and observed for colony formation and enumeration. At the highest laser energy (23 μJ), the colonies were too numerous to count, showing multiple colony morphologies including distinct fungal and bacterial growth (FIGS. 6A-D) of colonies on one of the array-printed agar plates for each of the laser energies investigated). As higher laser energy input would theoretically cause the most damage to the viability of the printed micro-organisms, it is clear that the BioLP enables printing of live micro-organisms. FIG. 6A shows the most colonies and most diversity, suggesting the highest density of printed viable microbes. At lower energies, single colonies could be counted due to the printing of less soil per laser pulse, and therefore, fewer culturable micro-organisms contained in each printed microparticle. Similar to the soil deposition experiments shown in FIG. 3, the culture results indicated fewer culturable micro-organisms were printed as the laser energy was decreased. The agar plates at each of the three lower laser energies resulted in consistent colony growth results, where printed plates at 14, 9 and 7 μJ laser energies resulted in 150, 106 and 18 colonies, respectively (see Table 1 for colony count data taken from both agar plate printing experiments). FIG. 6B (14 μJ) shows fewer colonies with distinct single and multiple isolates, suggesting a high density of printed viable microbes but fewer than with 23 μJ. FIG. 6C shows mostly single cell isolation, with colony density lower than at 14 μJ, suuesting fewer microbes per printed soil microdroplet. FIG. 6D shows exclusively single cell isolation (pure colony), but many printed droplets did not contain culturable microbes. Correlating well with the observation that a relatively small amount of soil was removed from the ribbon during the 7 μJ experiment, the culture plate printing experiment showed that there was enough soil deposited to result in isolation of culturable micro-organisms.

TABLE 1

Number of isolated colonies counted 24 h after direct soil printing onto LB agar plates at four different laser energies. The average number of colonies per printed microparticle was also calculated from this data (100 printed spots per plate).

| Energy (μJ) | Number of observed colonies from plate 1 | Number of observed colonies from plate 2 | Calculated average colonies generated per printed spot |
|---|---|---|---|
| 23 | N/A* | N/A* | N/A* |
| 14 | 78 | 72 | 0.75 |
| 9 | 50 | 56 | 0.53 |
| 7 | 7 | 11 | 0.09 |

*Unable to count due to overrun with overlapping colonies

Figure 4:
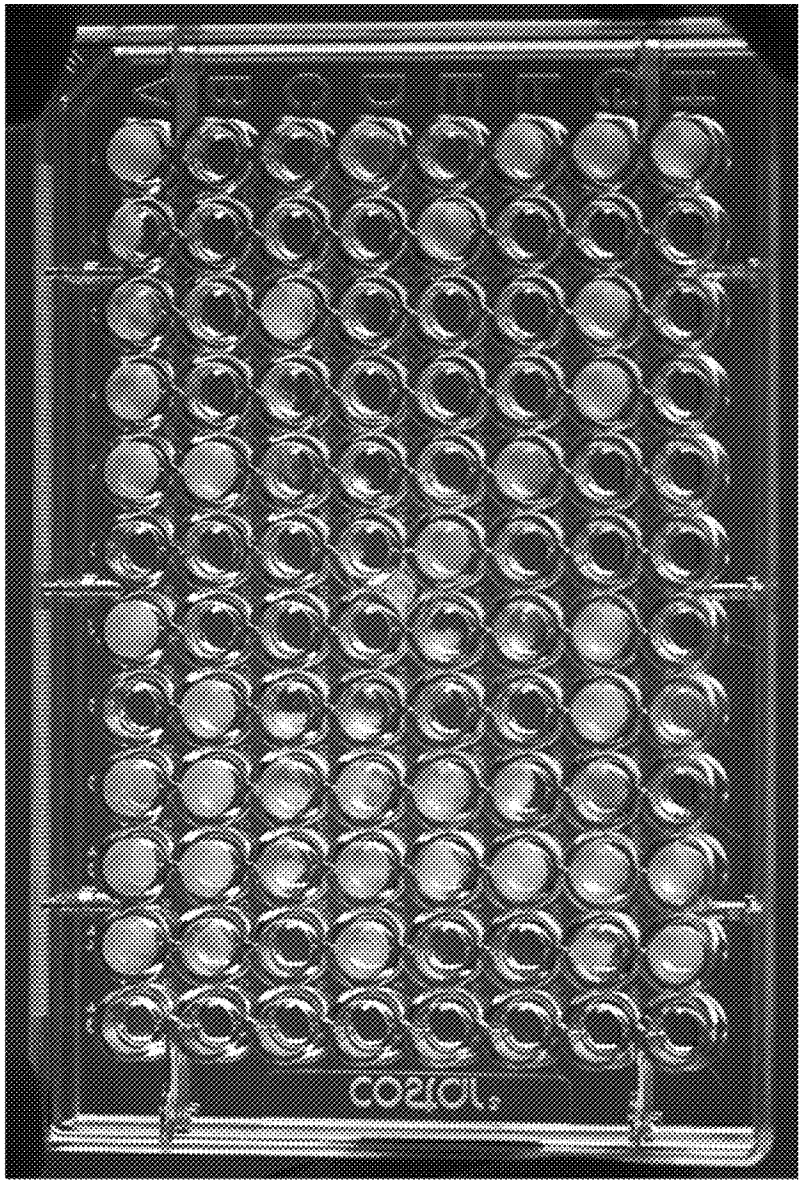
FIG. 4 shows a photograph of a soil printed 96-well plate after 72 hours of culture in LB broth.
Figure 5A:
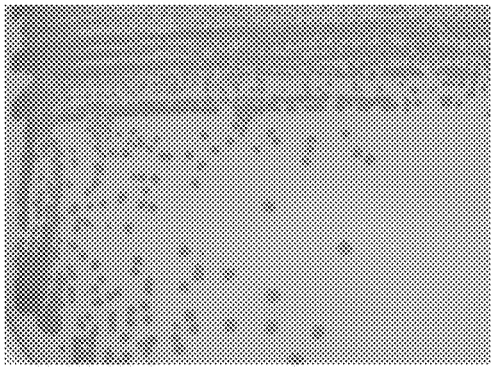
FIGS. 5A-H show representative samples of streaked LB agar plates from positive growth printed wells.
Figure 5B:
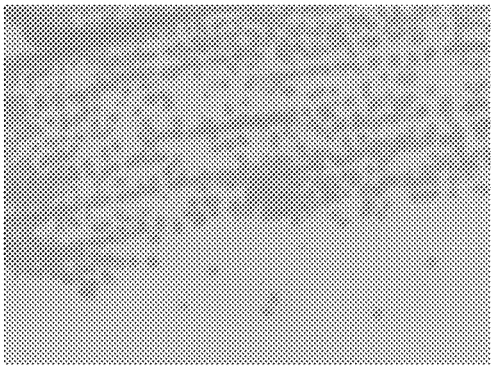
Figure 5C:
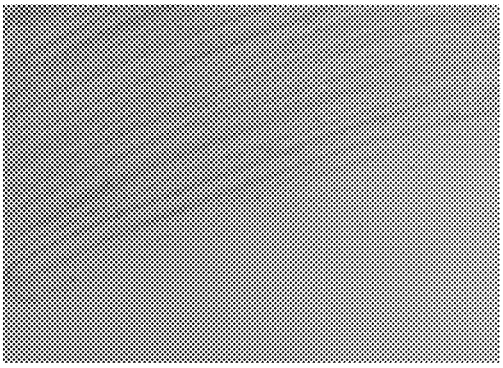
Figure 5D:
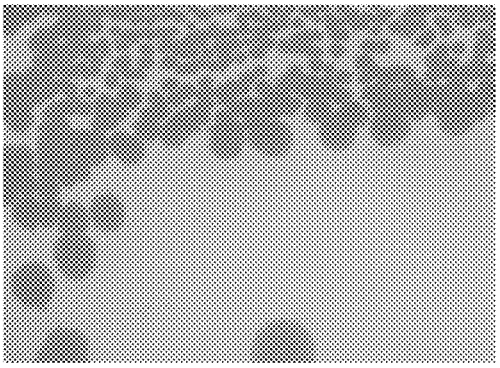
Figure 5E:
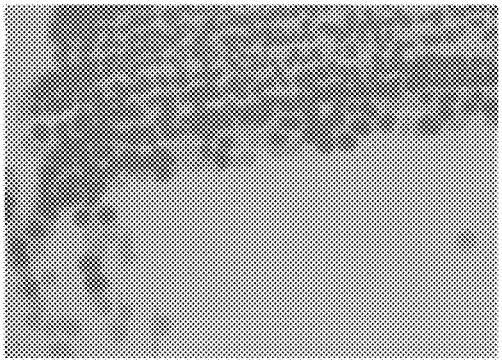
Figure 5F:
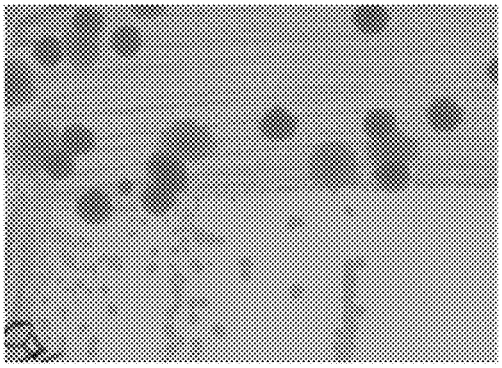
Figure 5G:
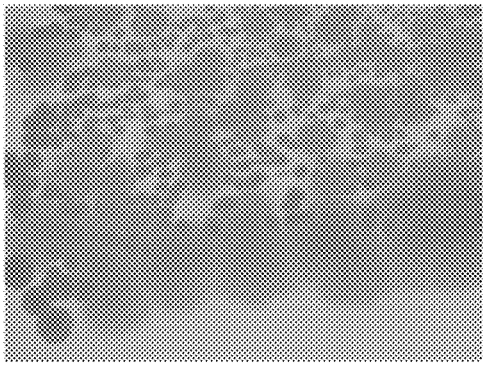
Figure 5H:
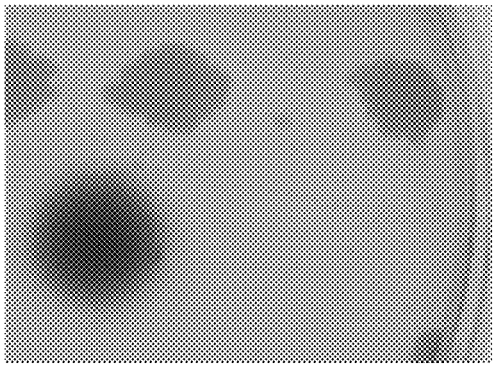
Figure 7:
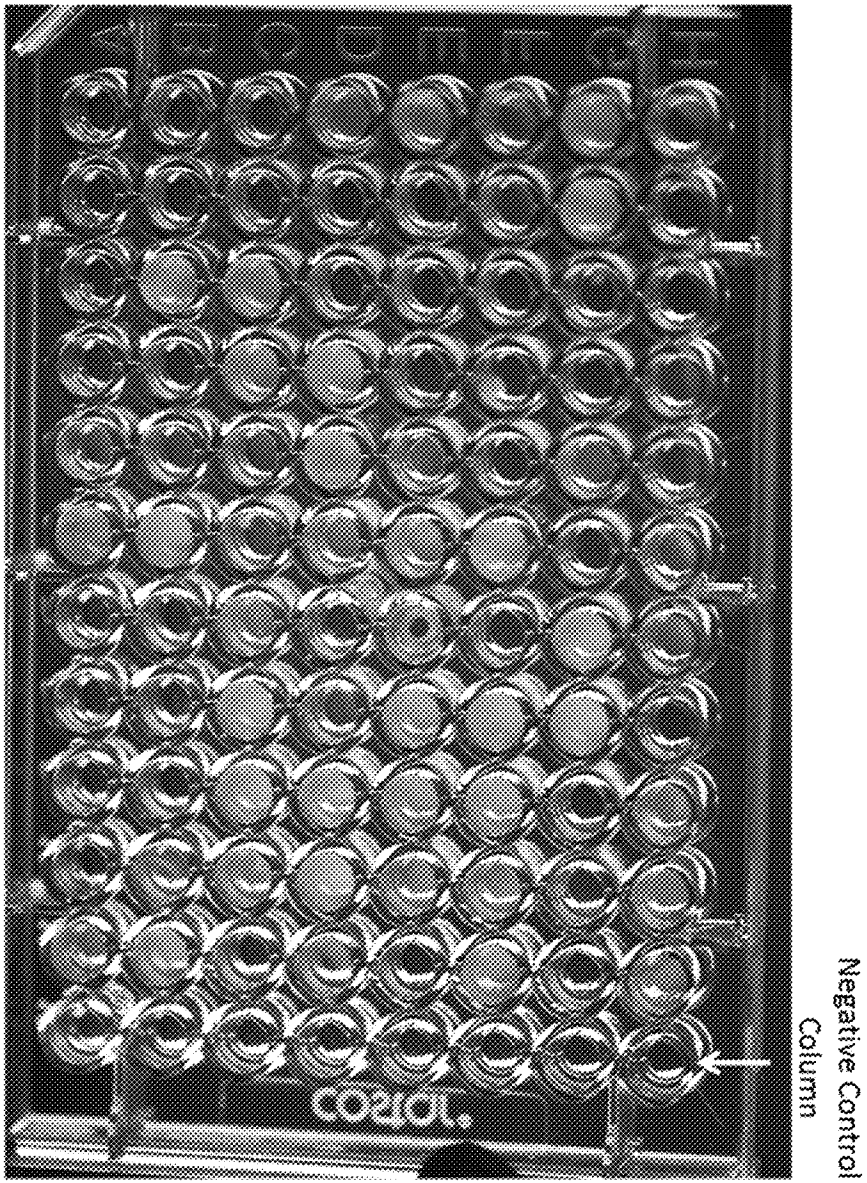
FIG. 7 shows the first replicate of soil sample printed to a 96-well plate showing 44 positive growth wells after 72 hour culture.
Figure 8:
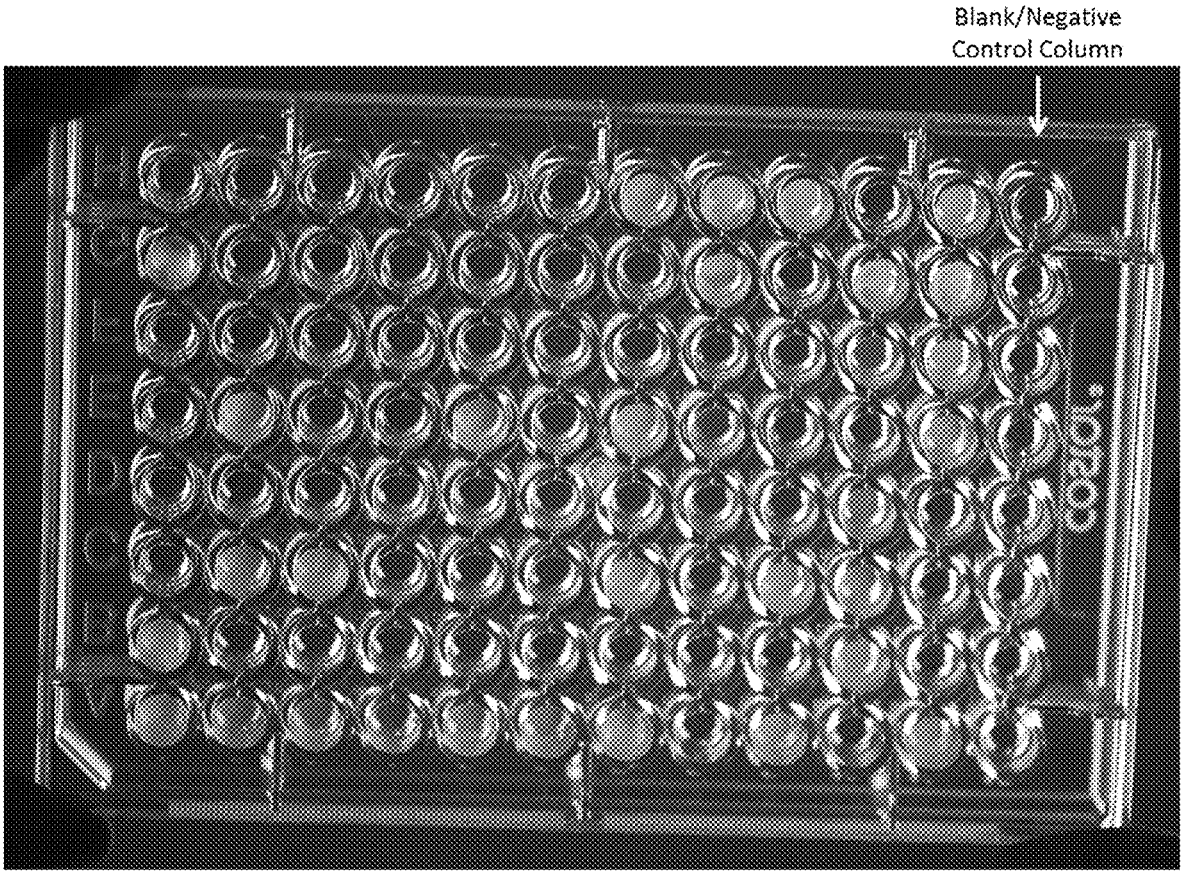
FIG. 8 shows the second replicate of soil sample printed to a 96-well plate showing 31 positive growth wells after 72 hour culture.

From the agar plate experiments, 9 μJ was selected as the optimal print condition for further study because that laser energy appeared to produce a nearly equal probability of either single isolates or mixed consortia per printed soil microparticle. Three 96-well sterile culture plates were filled with 200 μL of LB broth. BioLP was then used to print one microparticle of soil into 264 of the 288 wells, keeping 8 of the wells on each plate as negative controls with no printed microparticles. The negative wells remained uncovered during the printing experiment to determine whether cross-contamination occurred during microparticle printing (spraying) to neighboring wells. Each 96-well plate was then covered and incubated for 72 h at 30° C. One example of the printed 96-well culture plates is shown in FIG. 4 after the 72 h culture period. No turbidity and growth was observed in any of the 24 negative wells (see 8 of the wells on the far right side of FIG. 4 and replicates in FIGS. 7 and 8). Turbidity and growth was observed in 45 of the 88 printed wells for the experiment shown in FIG. 4. Consistent results were observed for the other two soil samples, as FIGS. 7 and 8 show good turbidity and growth in 44 and 31 wells, respectively.

Of the total 120 positive growth wells, 49 were selected for streaking onto LB agar plates to investigate the degree of microbial heterogeneity and diversity in the positive growth printed wells. These agar plates were observed after 24, 48, and 96 hours of incubation at 30° C. FIGS. 5A-H show representative streaked LB agar culture plates after 48 hours of incubation from 8 of the 49 samples. Additional incubation time did not change the colony morphologies or the number of distinct morphologies. FIGS. 5A-D are photographs of four distinct plate samples each showing different colony morphologies. Over half of the streaked LB agar plates showed single colony morphologies indicating that only one culturable species was present in those cultures. Overall, more than 10 different colony morphologies isolated in pure cultures were observed, indicating that soil printing to three 96-well plates resulted in isolation at least 10 distinct microorganisms. Additionally, there were several agar plates that showed multiple colony morphologies and colors (usually between 2 and 4), indicating that low number mixed consortia of microorganisms were isolated and cultured in some of the printed wells. FIGS. 5E-H are photographs that demonstrate four consortia isolated from printing soil to the 96-well plates. Based on colony morphology, it was concluded that at least 8 unique consortia were isolated. Additionally, colony morphology was used to determine that roughly equal percentages of the 49 sampled positive growth wells were determined to be pure cultures (53%) and complex cultures (47%, more than 2 distinct colony morphologies). These results demonstrate that in a single step BioLP was able to both isolate single culturable microorganisms and culturable microbial consortia directly from soil particles with almost equal probability.

By demonstrating a single-step method to isolate pure cultures and microbial consortia directly from soil, vortexing and sonication of the sample was avoided, which is often used by other high throughput techniques to generate liquid cultures by removing microorganisms from their solid-phase environmental sample matrix. BioLP soil printing therefore avoids cell lysis, consortia mixing, and potential incomplete sampling of biodiversity due to poor separation of microorganisms from the solid-phase particles. Additionally, because formation of the bio-ink requires only gentle stirring of the soil slurry, this pre-processing will not fully remove microorganisms from the soil particles. The direct soil printing method presented here most likely isolates near-neighbor microorganisms while they are still attached to the printed particles. For moist soils and ocean sediments, the solid material could be directly spread onto the ribbon as a bio-ink, avoiding mixing or stirring altogether. Alternative methods such as thin-slicing core samples could also be used to facilitate the retention of microbial near-neighbor spatial orientation prior to printing. Therefore, this method of soil printing is the first high throughput approach that attempts to maintain the natural micro-ecological environment, proximity, and relationship to near-neighbors throughout the isolation and screening process. Hypotheses in the current literature suggest that if these near-neighbor relationships can be maintained, a higher percentage of unculturable environmental microorganisms could be cultured under laboratory environments. Specifically, Joint et al. discusses the importance of maintaining consortia for marine samples: "The process of establishing laboratory cultures may destroy any cell-to-cell communication that occurs between organisms in the natural environment and that are vital for growth. Bacteria probably grow as consortia in the sea, and reliance on other bacteria for essential nutrients and substrates is not possible with standard microbiological approaches" (Joint et al., *Microb. Biotechnol.* 2010, 3(5), 564-575). It is clear from this statement that new technologies are needed to enhance the ability to culture the "unculturable". The results presented here indicate that BioLP soil printing may be used to maintain cell-to-cell communications and allow isolated samples to grow under laboratory conditions while mimicking the relationships between co-dependent species that help aid growth and survival in the natural environment.

Figure 9:
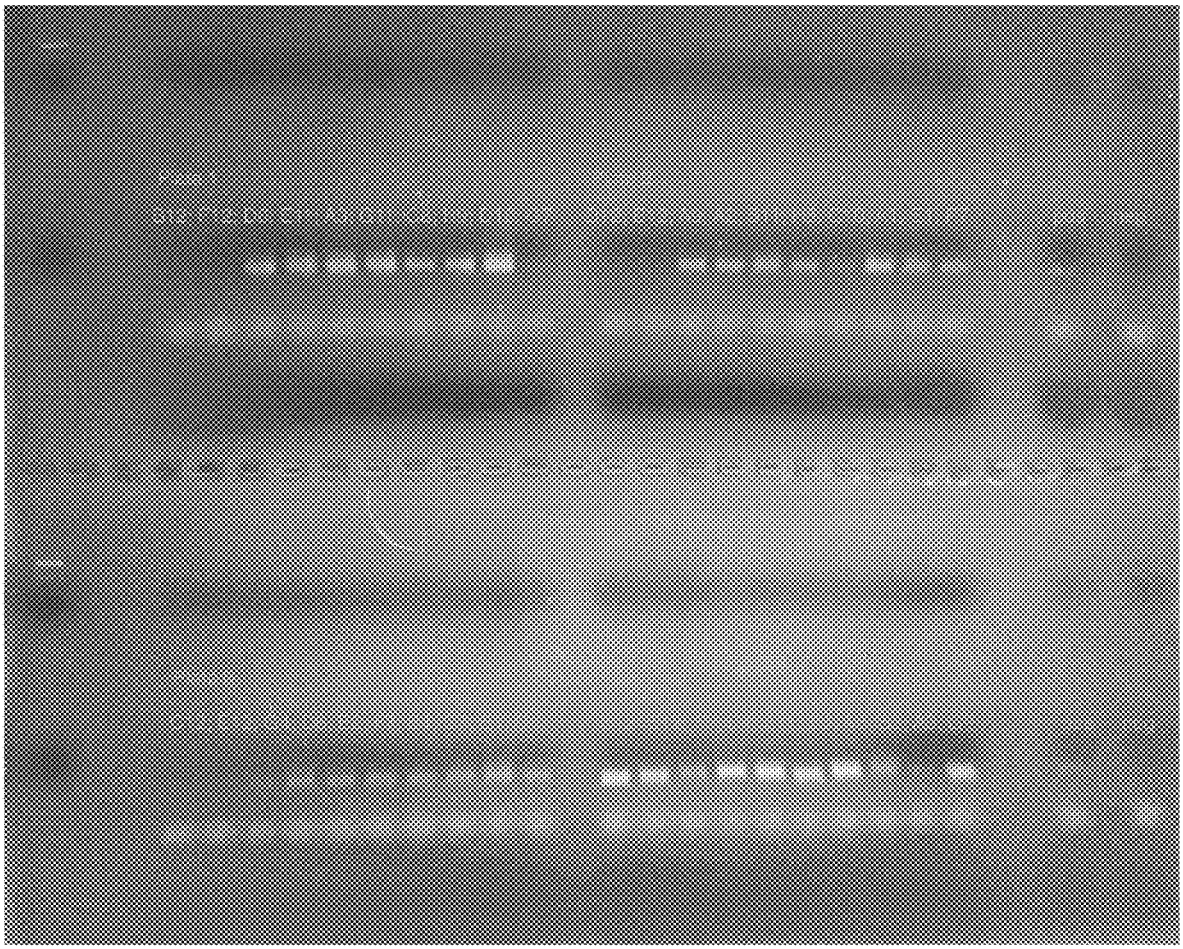
FIG. 9 shows an electrophoresis gel of amplified DNA from a printed soil microniche.

Additional experiments have been performed to demonstrate molecular analysis post-printing of microniches from a soil microbiome. Specifically, soil microniches were printed directly into a lysing buffer for preparation of polymerase chain reaction (PCR) amplification of 16s rRNA genes using bacterial-specific primers (27F* and 355R). The electrophoresis gel in FIG. 9 demonstrates that all printed soil samples amplified (representative wells listed as letter and number from well plates 1, 2, 3 and 4) while technical negative controls did not amplify (far right) and positive controls did amplify (adjacent to negative control data). The amplified DNA product shown below was then sequenced successfully, demonstrating that soil printing can be used to successfully (a) isolate small portions of a complex microbial ecosystem (microbiome) at a scale at least 10-100× smaller than previously demonstrated and while retaining spatial organization of the sample and microorganisms, (b) lyse microbial species in a solid-phase microbiome (in this case soil), and (c) ultimately sequence the DNA to enable deep characterization of the microorganisms present in the sample. Additional results indicate that characterizing microbiomes in this way not only allows one to completely map microorganisms spatially at the micro-scale but also identify more microbial heterogeneity and diversity than traditional sampling which is performed at much larger scales (~gram scale). This post-printing processing successfully showed that DNA can be extracted from isolated microniches of soil, and successful sequencing shows that information pertaining to the identity of microbial species in the printed samples can be determined.

Obviously, many modifications and variations are possible in light of the above teachings. It is therefore to be understood that the claimed subject matter may be practiced otherwise than as specifically described. Any reference to claim elements in the singular, e.g., using the articles "a", "an", "the", or "said" is not construed as limiting the element to the singular.

What is claimed is:

1. A method for printing materials comprising the steps of:

providing a receiving substrate;

providing a target substrate comprising a photon-transparent support, a photon absorbent interlayer coated on the support, and a transfer material comprising a solid-phase environmental sample coated on top of the interlayer opposite to the support;

wherein the environmental sample comprises living microorganisms;

wherein the transfer layer is formed by a method selected from:

mixing the solid-phase environmental sample with a liquid to form a suspension and forming a layer of the transfer material by applying the suspension to the target substrate and optionally drying the suspension; and forming a layer of the transfer material by applying a slice or portion of the environmental sample to the target substrate and optionally adding a fluid between the environmental sample and the target substrate;

providing a source of photon energy; and directing the photon energy through the transparent support so that the photon energy strikes the interlayer;

wherein a portion of the interlayer is energized by absorption of the photon energy; and wherein the energized interlayer causes a transfer of a portion of the environmental sample including the microorganisms across a gap between the target substrate and the receiving substrate and onto the receiving substrate.

2. The method of claim 1, wherein the environmental sample comprises living microorganisms adhered to or living in a soil particle.

3. The method of claim 1, wherein the environmental sample comprises living microorganisms adhered to or living in a sediment particle.

4. The method of claim 1, wherein the environmental sample comprises living microorganisms adhered to or living in human, animal or plant tissue.

5. The method of claim 1, wherein the environmental sample comprises living microorganisms adhered to or living in a biofilm.

6. The method of claim 1, wherein the environmental sample comprises living microorganisms adhered to or living in human or animal feces.

7. The method of claim 1, wherein the environmental sample comprises living microorganisms adhered to or living in agricultural, medical, or industrial waste or waste products.

8. The method of claim 1, wherein the environmental sample comprises living microorganisms adhered to or living in agricultural, medical, or industrial products.

9. The method of claim 1, wherein the receiving substrate comprises a culturing medium.

10. The method of claim 1, wherein the receiving substrate comprises a pH buffer, a lysing buffer, a DNA amplification reagent, a PCR primer, a sequencing reagent, an RNA preserving reagent, or a transcript preserving reagent.

11. The method of claim 1, further comprising:

incubating the transferred portion of the environmental sample.

12. The method of claim 1, wherein the photon-transparent support comprises quartz, sapphire, or amorphous silica.

13. The method of claim 1, wherein the photon absorbent interlayer comprises titania, gold, gold alloy, platinum, or titanium.

14. The method of claim 1, wherein the photon absorbent interlayer is 5-100 nm thick.

15. A substrate comprising:

a photon-transparent support;

a photon absorbent interlayer coated on the support; and a transfer material comprising a solid-phase environmental sample coated on top of the interlayer opposite to the support;

wherein the environmental sample comprises living microorganisms.

16. The substrate of claim 15, wherein the environmental sample comprises living microorganisms adhered to or living in a soil particle.

17. The substrate of claim 15, wherein the environmental sample comprises living microorganisms adhered to or living in a sediment particle.

18. The substrate of claim 15, wherein the environmental sample comprises living microorganisms adhered to or living in human, animal, or plant tissue.

19. The substrate of claim 15, wherein the environmental sample comprises living microorganisms adhered to or living in a biofilm.

20. The substrate of claim 15, wherein the environmental sample comprises living microorganisms adhered to or living in human or animal feces.

21. The substrate of claim 15, wherein the environmental sample comprises living microorganisms adhered to or living in agricultural, medical, or industrial waste or waste products.

22. The substrate of claim 15, wherein the environmental sample comprises living microorganisms adhered to or living in agricultural, medical, or industrial products.

23. The substrate of claim 15, wherein the photon-transparent support comprises quartz, sapphire, or amorphous silica.

24. The substrate of claim 15, wherein the photon absorbent interlayer comprises titania, gold, gold alloy, platinum, or titanium.

25. The substrate of claim 15, wherein the photon absorbent interlayer is 5-100 nm thick.

26. A method for printing materials comprising the steps of:

providing a receiving substrate;

providing a target substrate comprising a photon-transparent support, a photon absorbent interlayer coated on the support, and a transfer material comprising a solid-phase environmental sample coated on top of the interlayer opposite to the support;

wherein the environmental sample comprises living microorganisms adhered to or living in a soil particle;

providing a source of photon energy; and directing the photon energy through the transparent support so that the photon energy strikes the interlayer;

wherein a portion of the interlayer is energized by absorption of the photon energy; and wherein the energized interlayer causes a transfer of a portion of the environmental sample including the microorganisms across a gap between the target substrate and the receiving substrate and onto the receiving substrate.

* * * * *